US005461986A

United States Patent [19]

Sarnicki et al.

[11] Patent Number: 5,461,986

[45] Date of Patent: Oct. 31, 1995

[54] DIAGONALLY BRACED RAIL TRUCK WITH IMPROVED END BLOCK

[75] Inventors: John T. Sarnicki, Elgin; Thomas R. Berg, Clarendon Hills, both of Ill.

[73] Assignee: Standard Car Truck Company, Park Ridge, Ill.

[21] Appl. No.: 270,505

[22] Filed: Jul. 5, 1994

[51] Int. Cl.[6] ..... B61F 5/00

[52] U.S. Cl. ..... 105/165; 105/168; 105/182.1

[58] Field of Search ..... 105/168, 165, 105/166, 167, 182.1, 183, 199.1, 199.2; 267/220, 274, 293

[56] References Cited

U.S. PATENT DOCUMENTS

| | | | |
|---|---|---|---|
| 3,528,374 | 9/1970 | Wickens | 105/168 X |
| 3,563,185 | 2/1971 | Wilmot | 105/199.1 X |
| 4,162,653 | 7/1979 | Wickens | 105/168 X |
| 4,570,544 | 2/1986 | Smith | 105/165 |
| 4,870,914 | 10/1989 | Radwill | 105/167 X |
| 5,243,920 | 9/1993 | Lawson et al. | 105/168 X |

*Primary Examiner*—Robert J. Oberleitner
*Assistant Examiner*—Kevin D. Rutherford
*Attorney, Agent, or Firm*—Dorn, McEachran, Jambor & Keating

[57] ABSTRACT

A railroad car truck includes a pair of side frames and a bolster which is supported by springs on the side frame. There are diagonal cross braces attached to the side frames with each cross brace being attached to one side frame on one side of the bolster and being attached to the other side frame on the opposite side of the bolster. There are mounting brackets fixed to the side frame and there is an end block attached with elastomeric mounting elements to each mounting bracket. The end blocks mount the cross braces. Each end block has a profile such as not to materially interfere with the scan area of a hot box detector mounted adjacent one of the railroad track rails.

7 Claims, 2 Drawing Sheets

Fig. 1.
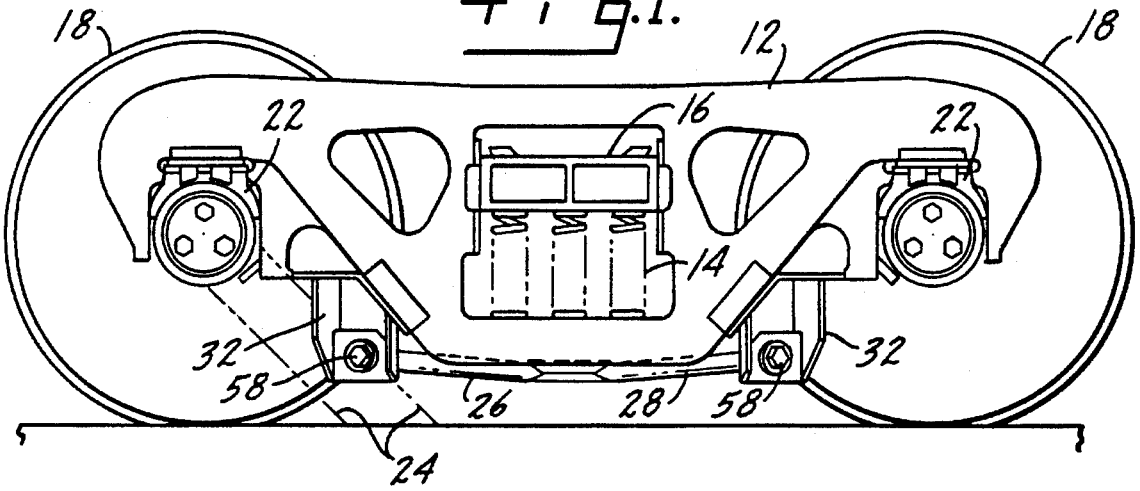
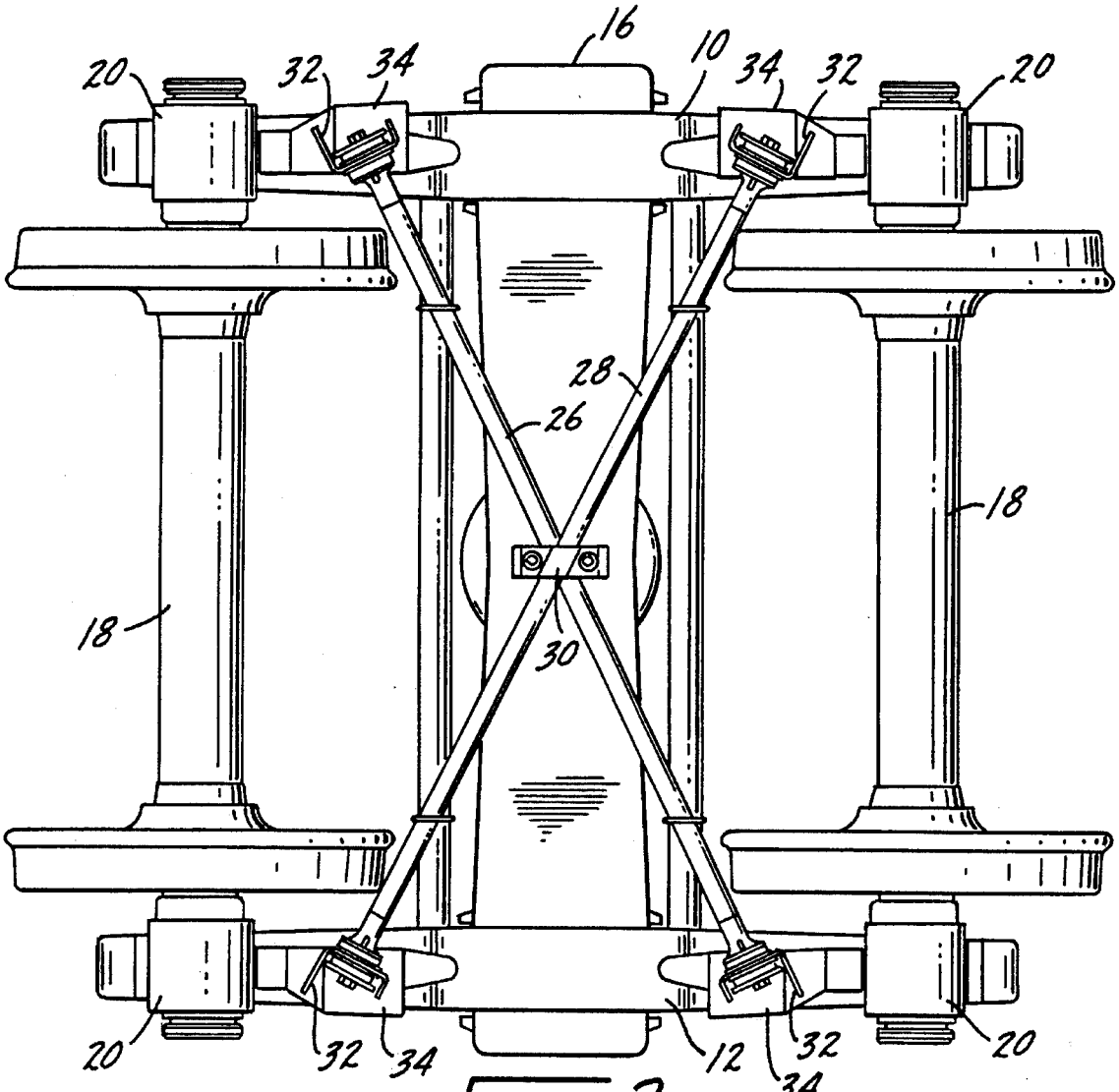
Fig. 2.

DIAGONALLY BRACED RAIL TRUCK WITH IMPROVED END BLOCK

THE FIELD OF THE INVENTION

The present invention relates to diagonally braced rail trucks of the type disclosed in U.S. Pat. Nos. 4,570,544 and 5,243,920, both owned by the assignee of the present application, Standard Car Truck Company. More specifically, the invention relates to an improvement in the end block which mounts the cross brace to the side frame.

It is common practice for railroads to utilize hot box detectors which look up from the rail at the roller bearings on a rail car truck at an angle of approximately 45° to the horizontal. The hot box detectors are designed to locate overheated bearings before such can cause damage to the truck and possible derailment of the car. In the past, the cross brace supports on some types of rail cars interfered with the scan area of the hot box detector and therefore diagonal cross brace trucks were not universally accepted by the railroads. The present application provides an end block which avoids any material interference with the scan area of the hot box detector.

SUMMARY OF THE INVENTION

The present invention relates to railroad trucks of the type utilizing diagonal braces between opposed portions of the car truck side frames and particularly to an end block design for mounting the cross braces, which end block design will not materially interfere with the scan area of a hot box detector.

Another purpose of the invention is to provide a diagonally braced rail truck of the type described having an improved end block design.

Another purpose is an end block design having a profile which reduces interference between the end block and a hot box detector scan area.

Another purpose of the invention is to provide a mounting arrangement for diagonal cross braces in a railroad car truck, which mounting arrangement utilizes an end block having an elongated nose and an integral circular flange, with the flange being formed and adapted to be supported by elastomeric elements on the mounting bracket attached to the side frame.

Other purposes will appear in the ensuing specification, drawings and claims.

BRIEF DESCRIPTION OF THE DRAWING

The invention is illustrated diagrammatically in the following drawings wherein:

FIG. 1 is a side view of a railroad car truck of the type disclosed herein;

FIG. 2 is a bottom plan view of the truck of FIG. 1;

DESCRIPTION OF THE PREFERRED EMBODIMENT

Figure 3:
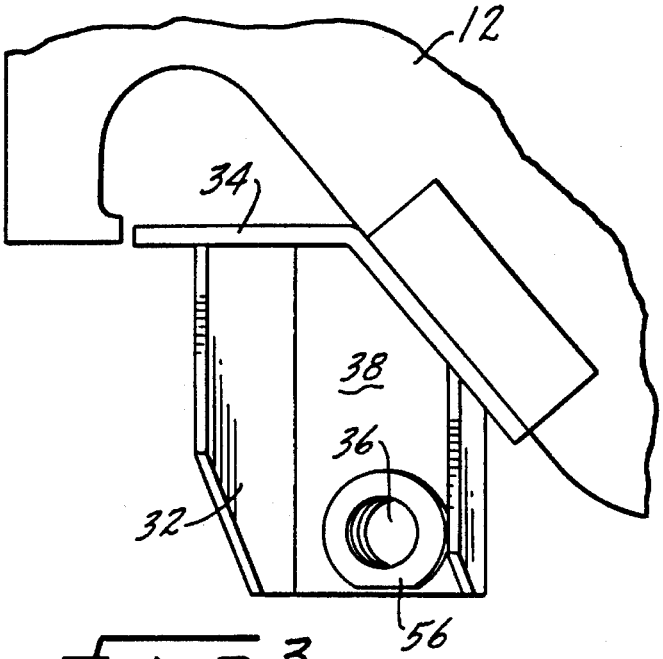
FIG. 3 is an enlarged side view of the mounting bracket supporting the diagonal cross braces.

In the drawings, a diagonally braced truck of the type disclosed in U.S. Pat. Nos. 4,570,544 and 5,243,920 is illustrated in FIGS. 1 and 2. There are side frames 10 and 12, each of which has a window within which are mounted load springs 14. The springs 14 support a bolster 16 as is conventional. There are a pair of wheelsets 18 each of which has roller bearings 20 on which are mounted roller bearing adapters 22. The adapters 22 support the side frame on the wheelsets.

As is known in the art, it is common practice for railroads to utilize hot box detectors to detect overheated roller bearings. Such detectors are normally mounted outboard of a rail and have an upward scan path which is at approximately 45° to the horizontal. The typical scan path for a hot box detector is illustrated in FIG. 1 and is bounded by the broken lines 24 which extend from the top of the rail up to the left-hand roller bearing of the truck.

The present invention is particularly concerned with an end block design which will not interfere with the scan path of the hot box detector.

The truck illustrated in FIGS. 1 and 2 has diagonal cross braces 26 and 28, each of which extends from an area generally adjacent one corner of one side frame to a diagonally opposite position on the other side frame. The mounting arrangement for the end of each cross brace is identical and only one will be described in detail. As shown in FIG. 2, the cross braces are attached to each other via an integrated clamp 30 which extends over the crossing diagonal braces and to the respective side frames via a huckbolt 58. The above-referenced U.S. Pat. Nos. 4,570,444 and 5,243,920 show further details and are herein incorporated by reference.

Figure 4:
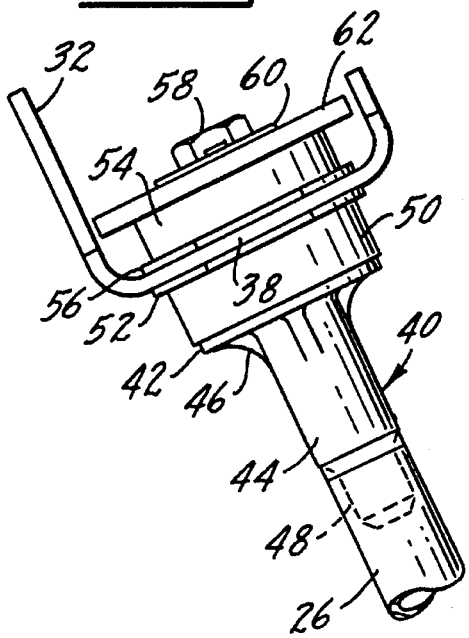
FIG. 4 is a bottom view of the end block and mounting bracket.
Figure 5:
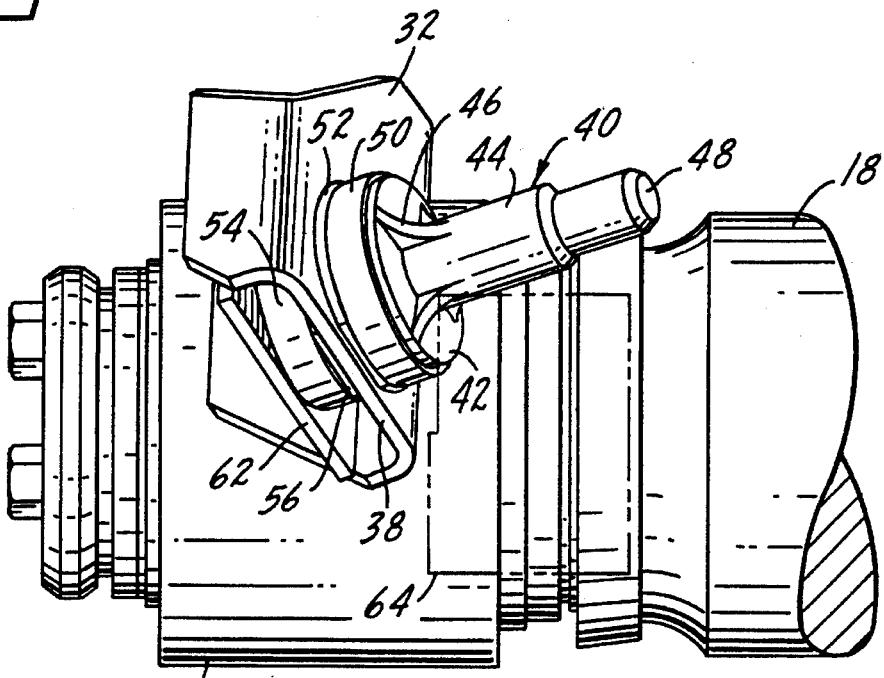
FIG. 5 is a side view, looking up at 45° to the horizon, on an enlarged scale, showing the mounted end block and its relationship to the scan area of a hot box detector and the truck roller bearing and axle.

The mounting arrangement for each end of each diagonal cross brace is illustrated in FIGS. 3, 4 and 5. There is a mounting bracket 32 which is attached by a base plate 34 to the side frame, conventionally by welding or the like. The bracket 32 has an opening 36 in one wall 38 thereof. The end block is illustrated at 40 and has a circular flange 42 and an axially extending nose 44 with fillets 46 being integral with both the flange and the nose for support. The nose 44 has a portion of reduced diameter, indicated at 48, which extends within the hollow interior of the cross braces 26 and 28 and thereby mounts the cross braces to the end block.

There is a first elastomeric mounting element 50 which is seated upon holding ring 52 which is welded to wall 38 of the mounting bracket 32. On the opposite side of wall 38 there is a similar elastomeric mounting element 54 and a holding ring 56 welded to wall 38. A bolt 58, washer 60, and locking plate 62 complete the support for the end block, with the bolt 58 passing through the mounting hole 36, elements 50, 52, 54, 56, and wall 38 of mounting bracket 32. Thus, the entire assembly is bolted to the mounting bracket with the end block extending toward the interior of the truck to mount to hollow diagonal cross braces 26 and 28.

Illustrated in FIG. 5 is the roller bearing 20 and the associated axle of a wheelset 18. Also shown in this figure is the location of the mounting bracket and the end block, as they would be located and positioned by the side frame. In broken lines at 64 is the A.A.R. assigned minimum scan area of the hot box detector. The long slender nose 44 of the end block is specifically designed so that there is minimum overlap between the end block and the scan area 64 of the hot box detector. In prior art end blocks there was substantial interference or overlap between the scan area and the end block which prevented appropriate utilization of the hot box detector. The present end block having an integral circular flange, long slender nose and supporting fillets is formed and adapted to provide the necessary secure mounting for the diagonal cross braces, but yet avoid interference with the scan path of the hot box detector.

Whereas the preferred form of the invention has been shown and described herein, it should be realized that there may be many modifications, substitutions and alterations thereto.

The embodiments of the invention in which an exclusive property or privilege is claimed are defined as follows:

1. A railroad car truck including a pair of side frames, a bolster supported by springs on said side frames, diagonal cross braces attached to said side frames, with each cross brace being attached to one side frame on one side of said bolster and being attached to the other side frame on the opposite side of the bolster, means for attaching each brace to a side frame including a mounting bracket fixed to the side frame, an end block attached to each mounting bracket, elastomeric mounting elements interconnected between each end block and its associated mounting bracket, each end block having a generally circular flange adjacent an elastomeric mounting element and an extended nose, said nose having a first portion of a first diameter and a second end portion of a second diameter, said second portion having a smaller diameter than said first portion, said second portion extending within an end of a cross brace, each end block having a profile such as not to materially interfere with a scan area of a hot box detector mounted adjacent one of a railroad track rail.

2. The truck of claim 1 characterized in that there is a first elastomeric mounting element positioned between said end block circular flange and one side of said mounting bracket, and a second elastomeric mounting element positioned on an opposite side of said mounting bracket.

3. The truck of claim 2 characterized by and including a locking plate positioned adjacent said second elastomeric mounting element.

4. The truck of claim 3 characterized in that said locking plate, elastomeric elements and end block are all connected together by a mounting bolt which extends from one side of said locking plate, through said elastomeric mounting elements and mounting bracket into said end block.

5. The truck of claim 2 characterized by and including holding rings positioned between each elastomeric mounting element and said mounting bracket.

6. The truck of claim 1 characterized by a plurality of fillets extending between each end block circular flange and its nose.

7. An end block for use in attaching a cross brace to a side frame of a railroad car truck, said end block including a generally annular flange adapted to be positioned against a side frame elastomeric mounting element, an axially extending nose integral with said flange, said nose having a first portion of a first diameter and a second portion of a second diameter, said second portion diameter being less than that of said first portion diameter, said second portion being formed and adapted to extend within a cross brace, and reinforcing means extending between and integral with said flange and axially extending nose, said axially extending nose having a profile such as not to materially interfere with a scan area of a hot box detector mounted adjacent one of a railroad track rail.

* * * * *